US005233900A

United States Patent [19]

Fitzgerald

[11] Patent Number: 5,233,900

[45] Date of Patent: Aug. 10, 1993

[54] MUSIC PAGE TURNER

[76] Inventor: Stephen P. Fitzgerald, 15 Eighth Avenue, St Peters, South Australia, Australia

[21] Appl. No.: 706,640

[22] Filed: May 29, 1991

[30] Foreign Application Priority Data

May 30, 1990 [AU] Australia ..... PK 0377

[51] Int. Cl.[5] ..... G10G 7/00

[52] U.S. Cl. ..... 84/497; 248/451; 24/67.11; 24/536

[58] Field of Search ..... 84/489, 495, 497, 498, 84/508, 511, 487, 486; 248/451, 452, 453; 24/67.5, 67.11, 536

[56] References Cited

U.S. PATENT DOCUMENTS

| | | | |
|---|---|---|---|
| 137,797 | 4/1873 | Rosenfield | 84/497 |
| 397,241 | 2/1889 | Loughlin | 84/497 |
| 1,165,431 | 2/1915 | Matthews | 84/497 |
| 1,252,355 | 1/1918 | Marcellino | 84/497 |
| 2,250,469 | 7/1941 | Crow | 24/536 |
| 3,065,565 | 8/1961 | Goodman | 248/451 |
| 4,378,102 | 3/1983 | Portis | 248/451 |
| 5,114,110 | 5/1992 | Vohora | 248/451 |

*Primary Examiner*—Michael L. Gellner
*Assistant Examiner*—Cassandra C. Spyrou
*Attorney, Agent, or Firm*—Edward W. Callan

[57] ABSTRACT

A device which will effectively turn a page, for example a page of a booklet of music, enabling a musician to play "hands free", has a book carrier (13) on a frame (11) and a number of page turner subassemblies (16) each with a disc (17) rotatable on an axle (12), each disc (17) having a notch (18) in its periphery, and also having an arm (20) radiating outwardly from the disc (17) and having a clip (57) to engage the page at the swinging end of the arm (20), and a spring (23) which will urge the arm (20) in a pivotal movement of the disc (17) in a page-turning direction, and an escapement mechanism (30) which co-operates with the notches (18) in the discs (17) to inhibit pivotal movement until released by a remote actuated controller (32).

7 Claims, 4 Drawing Sheets

MUSIC PAGE TURNER

This invention relates to a device which will effectively turn a page of a book, for example, a booklet of music, and can be remotely operated "hands free" by a musician, or as required by a disabled person (if applied to a book to be read).

BACKGROUND OF THE INVENTION

It is frequently a requirement to turn a page of music in a booklet of music (or for a disabled person to read a book), and unless an assistant is available, a musician needs page.

This problem has been recognised and whilst attempts have been made to provide an effective music page turner, the attempts known to the applicant have not been commercially acceptable on a large scale, and the main object of this invention is to provide a device which can be readily foot-operated (or otherwise operated remotely) to turn a page of music and thereby obviate the need for the presence of an assistant.

PRIOR ART

Very little prior art is known to the applicant. The prior art known includes an article in "Amateur Work" of June 1891 entitled "A Magnetic Leaf Turner" by one Alf Bean, Australian Patent Application AU/B/61001/86 in the name of Sony Corporation, and an Australian Patent 2473/31 in the name of Clarke. The first of said publication relates to a magnetic arrangement which does not appear to be similar in any relevant respect since it does not comprise a plurality of page turner subassemblies each with a disc rotatable on an axle and having a notch which is released by an escapement mechanism.

The Sony application also does not have the above-identified mechanism, but in lieu thereof utilises a vacuum which causes adherence of a first page and transport of the first page towards a second position.

The Australian patent 2473/31 utilises a ratchet rack arrangement which is a form of escapement mechanism but again does not include the above-identified characterising feature of this invention.

BRIEF SUMMARY OF THE INVENTION

A device which will effectively turn a page, for example a page of a booklet of music, enabling a musician to play "hands free" has a book carrier on a frame and a number of page turner subassemblies each With a disc rotatable on an axle, each disc having a notch in its periphery, and also having an arm radiating outwardly from the disc and having a clip to engage the page at the swinging end of the arm, and a spring which will urge the arm in a pivotal movement of the disc in a page-turning direction, and an escapement mechanism which co-operates with the notches in the discs to inhibit pivotal movement until released by a remote actuated x controller.

More specifically, the invention consists of a page turner comprising a frame, an axle carried by the frame, book support means, at least one page turner subassembly comprising a disc rotatable on the axle and having a notch forming surface defining a notch in its periphery, an arm radiating outwardly from the disc, page engaging means at the end of the arm, and spring means urging pivotal movement of the disc in a page-turning direction, an escapement mechanism in releasible engagement with the notch forming surfaces of respective said discs inhibiting said pivotal movement, a remote actuated controller, and coupling means coupling the sequentially release said engagement with the notch forming surfaces.

The escapement mechanism can include either an axial movement of a release bar which sequentially disengages from the disc notches and releases the discs one at a time to move the pages under the influence of a spring return attached to each disc, or it can include pawls which disengage from the disc notches. In a refinement of the invention, there can be provided means to initially remove the next page to be turned from the other pages of the booklet, and this can be achieved by having a cam surface which extends from near the end to the end of the release bar, and partially releases the next disc by sufficient amount to remove the next page from the succeeding pages. This prevents "suction" between the pages. In some embodiments of the invention one side of each disc is provided with a cam surface itself engaged by the end of the release bar so that some frictional constraint is applied which reduces the velocity at which the disc and arm rotates in turning a page, thereby reducing the danger of possibility of disengagement of a page from the page engaging means.

An alternative escapement utilises a release shaft which is parallel with the axle, and which has cams which urge pawls into release positions with a respective notches of the discs.

The remote controller can be for example a foot actuated pump switch or Bowden cable which is coupled to a ratchet wheel or to a pivoted pawl in such a way that sequential actuation of the foot operated controller will cause sequential turning of the pages of the booklet of music.

BRIEF SUMMARY OF THE DRAWINGS

An embodiment of the invention is described hereunder in some detail with reference to and is illustrated in the accompanying drawings in which.

DETAILED DESCRIPTION OF THE EMBODIMENTS

Figure 1:
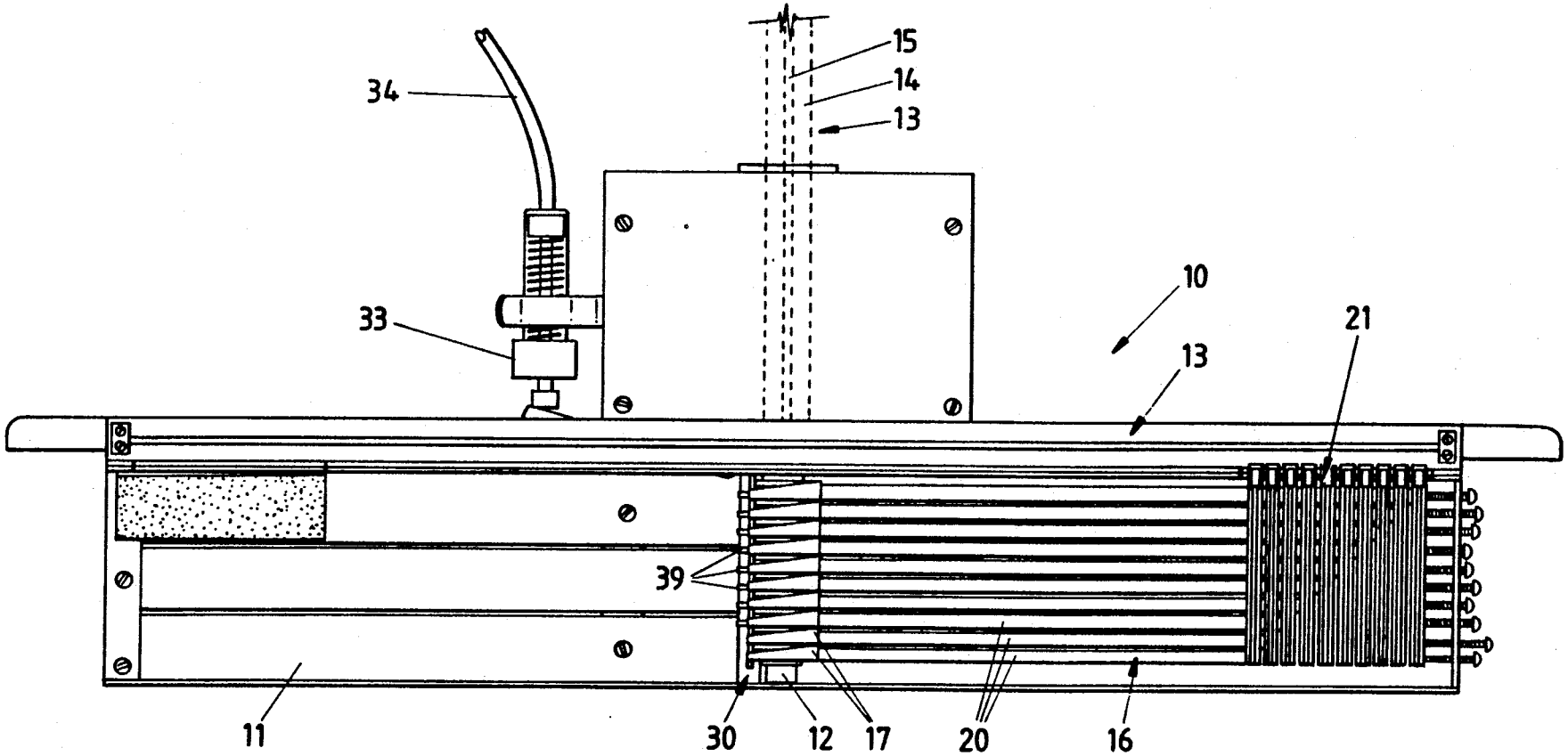
FIG. 1 is a diagrammatic plan view of a page turning according to this invention.
Figure 2:
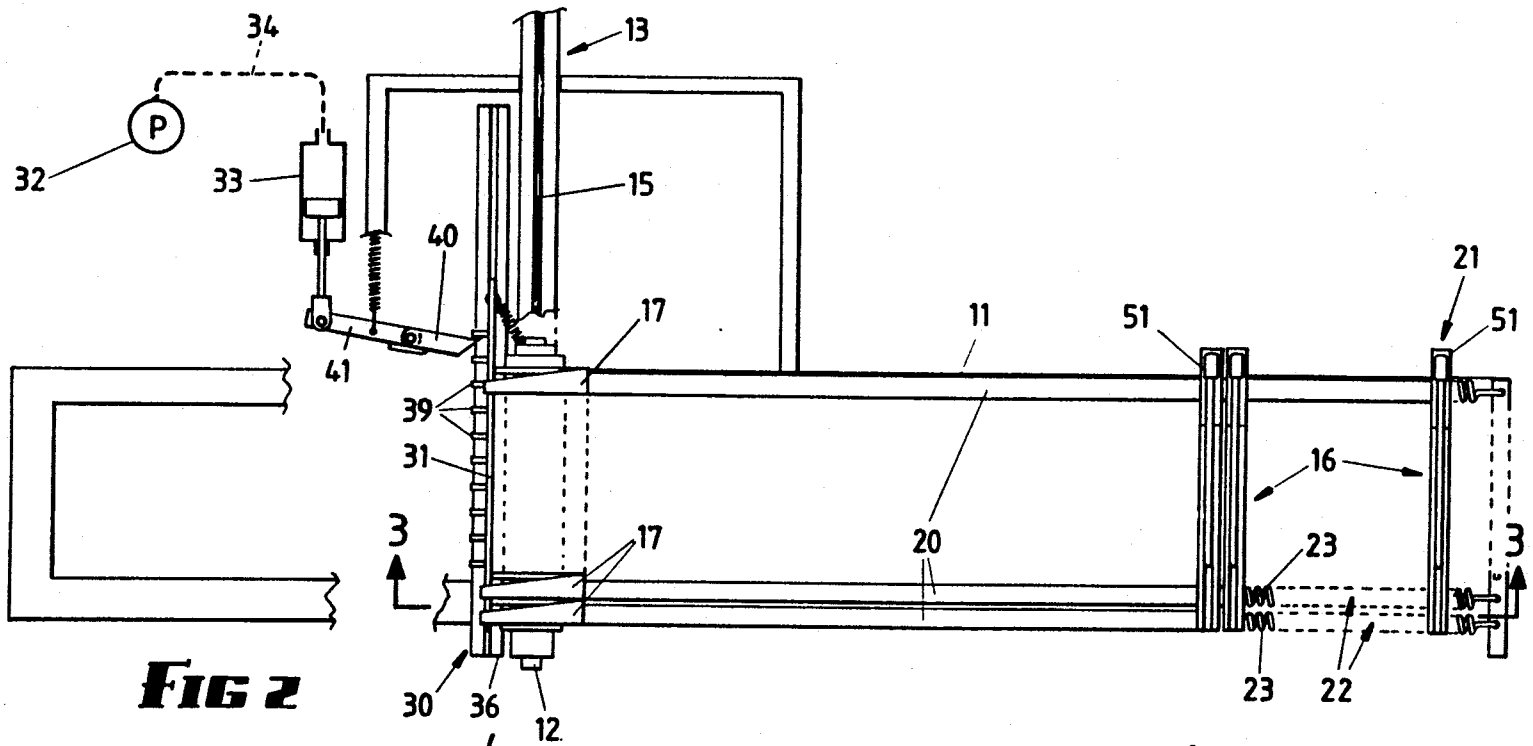
FIG. 2 is a fragmentary plan drawn to a larger scale and illustrating the actuation of an escapement mechanism utilising a release bar which moves in a linear direction.
Figure 3:
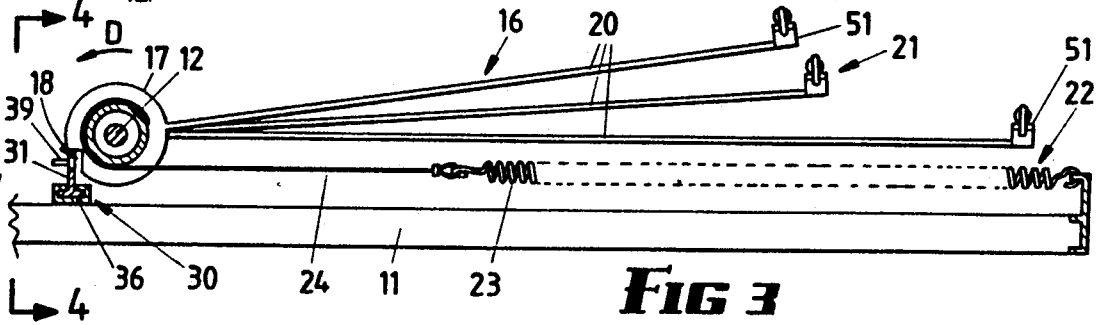
FIG. 3 is a partly sectioned elevation of FIG. 2, the section being taken on line 3—3 of FIG. 2.

A first embodiment is described with respect to FIGS. 1 through to 10.

In the first embodiment, a page turner 10 comprises a frame 11 which carries on it an axle 12, and a book carrier 13 which is releasably retained by a bracket on the frame 11, the book carrier 13 comprising a book support bar 14 and a book retaining cord 15 which is substantially coaxial with the axle 11.

Figure 6:
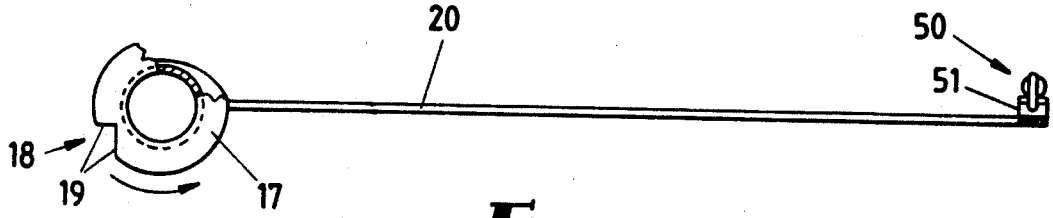
FIG. 6 is an elevation of FIG. 5.

There are provided a plurality of page turner subassemblies 16 and each page turner subassembly 16 comprises a disc 17 rotatable on the axle 12 and having a notch 18 formed by two notch forming surfaces 19 which are at right angles with one another as shown in FIG. 6. Each disc 17 has an arm 20 radiating outwardly therefrom (ten arms 20 being illustrated), and each arm 20 terminates in page engaging means 21.

Figure 5:
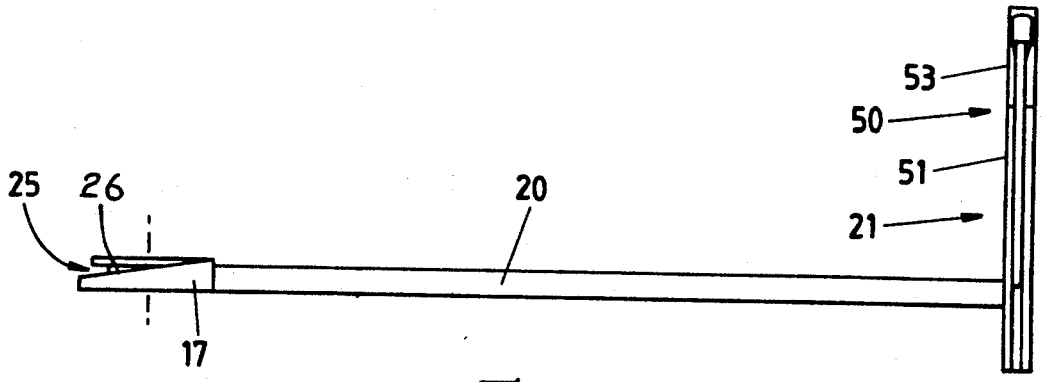
FIG. 5 is a plan view of a disc, arm and page engaging means.

Although use may be made of flat helical torsion springs, in this embodiment spring means 22 comprise springs 23 coupled to the respective discs by cords 24 each cord 24 extending partway around the disc 17 and in a groove 25 (FIG. 5).

An escapement mechanism 30 comprises a spring return release bar 31 which is in releasable engagement with the notch forming surfaces 19 of respective discs 17 and which will inhibit pivotal movement.

A remote actuated controller 32 is constituted by a foot actuated pump 32 which is shown only diagrammatically, and this is coupled to a small hydraulic cylinder 33 by a tube 34, although the foot actuated pump 32 may be hand actuated, may be replaced by a Bowden cable arrangement, or may be an electric switch and the cylinder 33 may be replaced by a solenoid.

Figure 4:
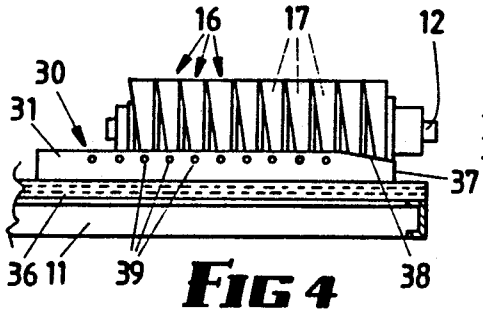
FIG. 4 is a side elevation of the release bar showing the cam surfaces and abutment surfaces thereof.

When the foot actuated pump 32 is depressed, the release bar 31 moves in a lineal direction, being guided by guides 36, the release bar 31 having its end 37 (FIG. 4) progressively moving away from the respective discs 17, and each time it moves away from a disc it releases that disc so that the discs are released sequentially. An end surface 26 of each disc is a cam surface against which end 37 bears, and frictional engagement snubs the page turning movement, reducing impact and other forces which may otherwise interfere with smooth movement as a page is turned. Adjacent the end 37, the release bar 31 has a cam surface 38 Which slopes downwardly towards the end, so that when one disc is released, the one next to it about to be released is allowed to move slightly in the direction D so that any page which is retained by the page turner subassembly 16 is removed from the remaining pages of a book, avoiding the "suction" of the pages as they are turned.

In order to effect the sequential withdrawal of the release bar 31 from the discs 17, the bar 31 has a plurality of abutment surfaces being surfaces of pins 39 which stand out from the side of the bar 30, and these are engaged by a pivoted pawl 40 carried on a swivelling arm 4 which is actuated by the cylinder 33. Return of the bar 31 is effected by its spring, and by manually returning an arm beyond its "rest" position, all notch surfaces otherwise engaged by the bar become clear of the bar which readily returns.

Figure 11:
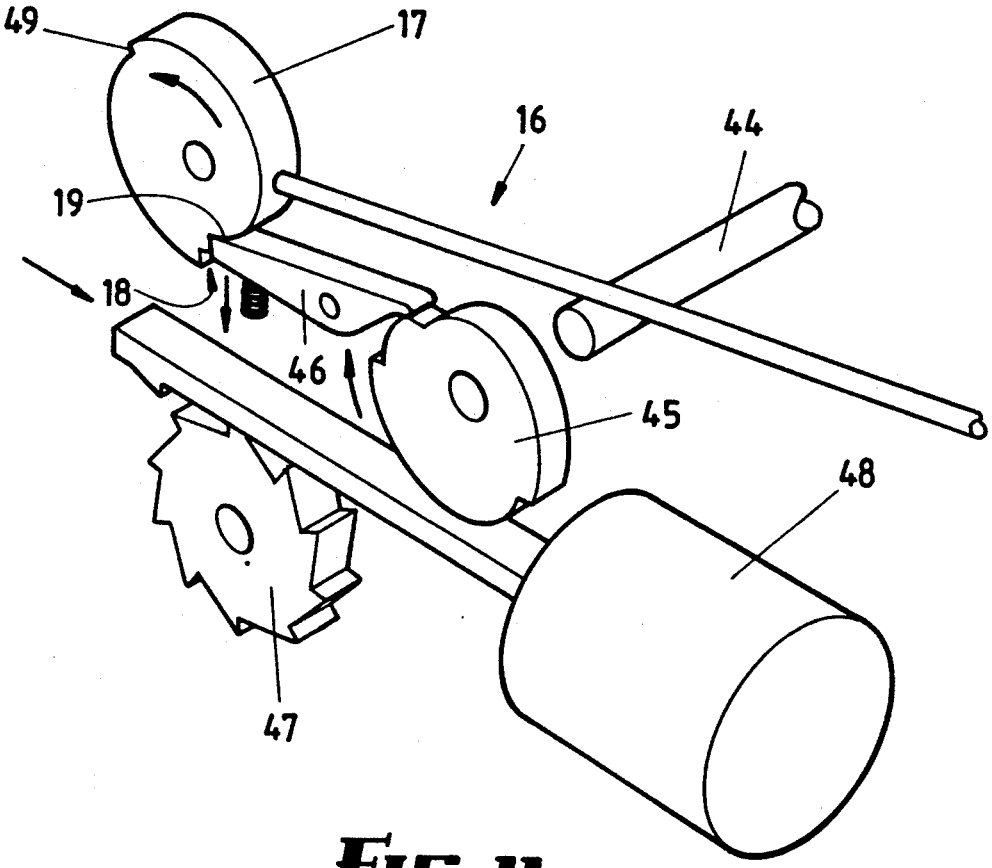
FIG. 11 is a diagrammatic perspective view illustrating the different type of escapement mechanism.

The arrangement shown diagrammatically in FIG. 11 indicates use of a rotary release shaft 44 instead of the sliding release bar 31, the release shaft 44 carrying on it release cams 45 which in turn engage release pawls 46 to remove them from the notch forming surfaces 19 of the discs 17. Sequential rotation of the shaft 44 is achieved by a solenoid operated ratchet wheel 47 which is actuated by a solenoid 48. The initial release of the escapement mechanism 30 is achieved by having the notch forming surfaces 19 being stepped, and the cams 45 being consequentially stepped, and primary termination of page turning is achieved in the embodiment of FIG. 11 by a small projection 49 on disc 17. In the first embodiment this is unnecessary because of the engagement of the release bar end 37 against the cam surface 26 on each of the respective discs 17 snubbing movement of the arm 20.

Figure 7:
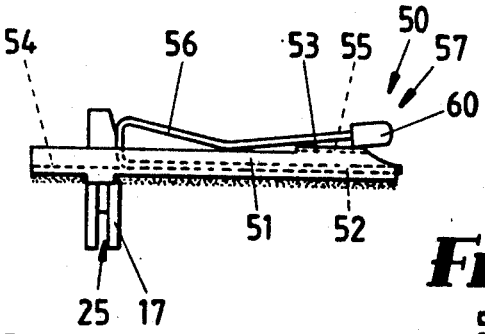
FIG. 7 is an elevation of a page engaging means.
Figure 8:
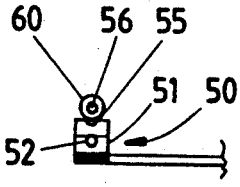
FIG. 8 is an end elevation of FIG. 7.
Figure 9:
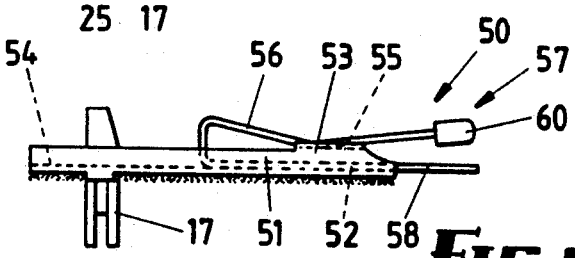
FIG. 9 is an elevation similar to FIG. 7 which shows a U-shaped spring clip of the page engaging means partly extended from the page bar so that its legs are separated and will receive a page.
Figure 10:
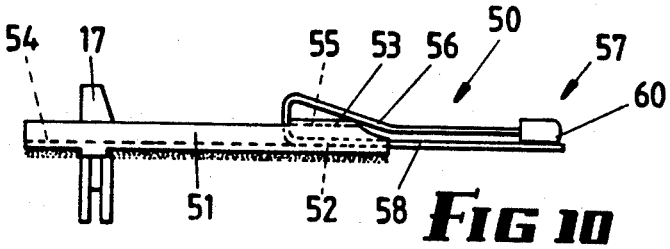
FIG. 10 is a view similar to FIG. 9 with a clip fully extended with its legs contiguous to engage opposite faces of a page.

Reference is now made to the page engaging means 21 illustrated in detail in FIGS. 5 through to 10. Each arm 20 terminates in a page bar 51, and each page bar 51 extends from the end of an arm 20 in a direction which is generally parallel to the axle 12. An aperture 52 extends through a page bar projection 53, which is aligned with a first groove 54, and the projection has an upper surface which includes a second groove 55 extending along the top of the projection 53 and providing a cam surface which receives the upper leg 56 of a U-shaped page retaining clip 57, the lower leg 58 of a clip 57 being retractable on the bar 51 as shown in FIG. 7, but when the clip 57 is partly extended as in FIG. 9, the two legs 56 and 58 are separated, and as shown in FIG. 10 when fully extended they lie contiguous with one another. A small rubber cap 60 on the end of the leg 56 provides a frictional engagement with a page.

By carefully gripping a page mechanically between the rubber cap 60 and the leg 58, by commencing movement to break one page away from the next before turning the page, and by snubbing the movement of the page against rotation, a very effective and reliable page turner is achieved.

I claim:

1. A page turner comprising a frame, an axle carried by the frame, a book support means, a plurality of page turner subassemblies each comprising a disc rotatable on the axle and a notch forming surface defining a notch in the periphery of the disc, a rotatable arm radiating outwardly from the disc to rotate therewith, page engaging means at one end of the arm, and spring means urging pivotal movement of the disc in a page-turning direction, an escapement mechanism in releasable engagement with the notch forming surface of each said disc, inhibiting said pivotal movement, said escapement mechanism comprising a spring return release bar, guide means guiding said release bar for lineal movement, the release bar engaging the notch forming surfaces of the discs before page turning thereof, and a remote actuated controller, and coupling means coupling the controller to the release bar of the escapement mechanism to effect the lineal movement thereof and in turn sequentially release said engagement of the release bar with the notch forming surfaces, wherein each of said discs comprises a first cam surface frictionally engaged by an end of the release bar upon release of engagement of the notch forming surface of said disc by the bar, such frictional engagement being effective to reduce a velocity at which said one end of the arm radiating outwardly from said disc rotates in the page turning direction.

2. A page turner according to claim 1 wherein each of the notches is shaped and dimensioned so that each of the arms can be rotated, against said pivotal movement of the disc urged by the spring means, through a small arc beyond a rest position, the notch forming surfaces, when the arms are thus rotated, being held clear of an upper edge surface of the release bar to thereby allow the release bar to freely return.

3. A page turner according to claim 1 wherein the book support means comprises a book carrier having a book support bar and a book retaining cord extending along the book support bar and secured thereto, the cord being in axial alignment with the axle.

4. A page turner according to claim 1 wherein said coupling means comprises an array of abutment surfaces on said release bar, an actuating member sequentially engaging the abutment surfaces for effecting said bar lineal movement.

5. A page turner comprising a frame, an axle carried by the frame, a book support means, at least one page turner subassembly comprising a disc rotatable on the axle and having a notch forming surface defining a notch in the periphery of the disc, an arm radiating outwardly from the disc, page engaging means at one end of the arm, and spring means urging pivotal movement of the disc in a page-turning direction, an escapement mechanism in releasable engagement with the notch forming surface of said disc, inhibiting said pivotal movement, and a remote actuated controller, and coupling means coupling the controller to the escapement mechanism to be controllable to sequentially release said engagement with the notch forming surface, wherein each said page engaging means comprises a page holder having a page bar extending from said one end in a direction generally parallel to the axle, an aperture in the page bar, a cam surface on the page bar, a U-shaped resilient clip having a pair of legs, one of said legs being slidable in the aperture, a second of said legs being slidable over the cam surface, the page bar and the clip being shaped such that, when the clip is retracted on the bar a surface defining the aperture and the cam surface spread the legs, but when extended from the page bar, resilience of the clip causes projecting ends of the legs to lie contiguous with each other in a page retaining configuration.

6. A page turner according to claim 5 further comprising a projection outstanding from an end of the page bar, a first groove in a wall of the projection, said cam surface being a surface of the first groove, a second groove in the page bar parallel to said first groove and continuous with, and aligned with, said aperture, said U-shaped clip being a length of spring wire having resilient characteristics, said other leg extending through the first groove whilst said one leg extends along a portion of the second groove and through the aperture when in said page retaining configuration.

7. A page turner comprising a frame, an axle carried by the frame, a book support means, a plurality of page turner subassemblies each comprising a disc rotatable on the axle and a notch forming surface defining a notch in the periphery of the disc, a rotatable arm radiating outwardly from the disc to rotate therewith, page engaging means at one end of the arm, and spring means urging pivotal movement of the disc in a page-turning direction, an escapement mechanism in releasable engagement with the notch forming surface of each said disc, inhibiting said pivotal movement, said escapement mechanism comprising a spring return release bar, guide means guiding said release bar for lineal movement, the release bar engaging the notch forming surfaces of the discs before page turning thereof, and a remote actuated controller, and coupling means coupling the controller to the release bar of the escapement mechanism to effect the lineal movement thereof and in turn sequentially release said engagement of the release bar with the notch forming surfaces, wherein each of said discs comprises a first cam surface frictionally engaged by an end of the release bar upon release of engagement of the notch forming surface of said disc by the bar, such frictional engagement being effective to reduce a velocity at which said one end of the arm radiating outwardly from said disc rotates in the page turning direction, and wherein said end of the release bar comprises a second cam surface which effects a partial release of engagement of the notch surface of said disc by an amount sufficient to remove a next-to-turn page from the succeeding unturned pages, before said lineal movement effects full release thereof.

* * * * *

UNITED STATES PATENT AND TRADEMARK OFFICE

CERTIFICATE OF CORRECTION

PATENT NO. : 5,233,900

DATED : August 10, 1993

INVENTOR(S) : STEPHEN P. FITZGERALD

It is certified that error appears in the above-identified patent and that said Letters Patent is hereby corrected as shown below:

Column 1, line 14, after "need", insert --to remove his hands from his instrument in order to turn the--.

Column 1, line 50, change "With" to --with--.

Column 1, line 58, delete "x".

Column 2, line 3, after "the", insert --controller to the escapement mechanism to be controllable to--.

Signed and Sealed this

Sixteenth Day of May, 1995

*Attest:*

Bruce Lehman

BRUCE LEHMAN

*Attesting Officer*

*Commissioner of Patents and Trademarks*